US005143541A

United States Patent [19]

Sugitani

[11] Patent Number: 5,143,541

[45] Date of Patent: Sep. 1, 1992

[54] PROCESS FOR PRODUCING POWDERED METAL SPRAY COATING MATERIAL

[75] Inventor: Nobuhiro Sugitani, Tokyo, Japan

[73] Assignee: Sugitani Kinzoky Kogyo Kabushiki Kaisha, Tokyo, Japan

[21] Appl. No.: 708,762

[22] Filed: May 31, 1991

Related U.S. Application Data

[62] Division of Ser. No. 523,223, May 14, 1990, Pat. No. 5,039,477.

[30] Foreign Application Priority Data

Jun. 2, 1989 [JP] Japan ..... 1-139228
Sep. 5, 1989 [JP] Japan ..... 1-228343

[51] Int. Cl.[5] ..... C22C 33/04
[52] U.S. Cl. ..... 75/338; 75/352
[58] Field of Search ..... 75/338, 352, 355

[56] References Cited

U.S. PATENT DOCUMENTS 3,009,205 11/1961 Monson et al. ..... 75/338
3,646,177 2/1972 Thompson et al. ..... 75/338
3,698,055 10/1972 Holtz et al. ..... 75/338
4,626,278 12/1986 Kenney et al. ..... 75/355
4,778,516 10/1988 Raman ..... 75/338

*Primary Examiner*—George Wyszomerski
*Attorney, Agent, or Firm*—Kane, Dalsimer, Sullivan Kurucz, Levy, Eisele and Richard

[57] ABSTRACT

A powdered metal spray coating material comprises two or more of Ni, Cr and Co, and 0.1 to 1.0% by weight of Y based on the total weight of the spray coating material. If Co is present in this spray coating material, the content of Co is in a range of 20 to 40% by weight, and the balance is Ni and/or Cr. If Cr is present, the content of Cr is in a range of 15 to 30% by weight, and the balance is Ni and/or Co. Such powdered metal spray coating material is produced by melting and homogenizing starting metal in vacuum and forming them into a metal powder by a gas atomizer.

2 Claims, No Drawings

PROCESS FOR PRODUCING POWDERED METAL SPRAY COATING MATERIAL

This is a divisional of copending application Ser. No. 07/523,223 filed on May 14, 1990, now U.S. Pat. No. 5,039,477.

BACKGROUND OF THE INVENTION

1. Field of the Invention

The present invention relates to a powdered metal spray coating material which provides a good spray coating property to the base matel as well as excellent durability and heat and wear resistances, and capable of improving the spray coating property of a ceramic layer which will be subsequently formed thereon by spray coating, and to a process for producing such a material and the use thereof.

2. Description of the Prior Art

There is a known continuously casting mold which has a Ni-plated layer formed on an inner surface thereof, and a Co-Mo-Cr alloy layer formed thereonto by spray coating and consisting of 45 to 65% by weight of Co, 20 to 40% by weight of Mo and the balance of Cr, as disclosed in Japanese Patent Publication No. 5819/86. When this continuously casting mold is used as a mold for common discontinuously casting processes, e.g., low pressure casting and gravity casting processes, a disadvantage is encountered that a blown or rugged portion may be produced, resulting in a degraded surface of a molded product, because a gas cannot be sufficiently removed during casting.

The present inventors have proposed, in Japanese Patent Application No. 46621/89, that after spray coating of a metal, a porous $Al_2O_3/ZrO_2$ ceramic layer is provided on such coating layer by spray coating for the purpose of solving the above disadvantage.

However, there is a disadvantage of a very poor spray coating deposition of the ceramic layer onto the above prior art alloy layer. Further, the alloy layer has only still unsatisfactory wear and heat resistances and hence, a spray coating material having such properties improved has been desired.

Further, a spray coating material represented by "NiCoCrAlY" is disclosed in Hiromitsu Takeda, "Ceramic Coating", 195–205 Sep. 30, 1988) issued by Dairy Industrial Press, Co., Corp. This spray coating material consists of Ni, Co, Cr, Al and Y and has a composition comprising 25% by weight of Co, 13% by weight of Al, 17% by weight of Cr, 0.45% by weight of Y and the balance of Ni. The spray coating material undoubtedly has an excellent spray coating property and provides an excellent deposition of a ceramic spray coating and excellent heat and wear resistances, but suffers from a disadvantage that when the material after spray-coating comes into contact with the melt of magnesium or a magenesium alloy, or aluminum or an aluminum alloy, e.g., when a molded product of such a metal is produced using a mold, aluminum itself in the spray coating material may be deposited on a molded product, and/or aluminum or magnesium itself in the molded product may be adhered to a spray-coated substrate or mold blank.

SUMMARY OF THE INVENTION

It is an object of the present invention to provide a spray coating material which is free from the disadvantages associated with the above prior art spray coating materials and provides excellent heat and wear resistances to the surface of a substrate.

To achieve the above object, according to the present invention, there is provided a powdered metal spray coating material which comprises two or more of Ni, Cr and Co, and 0.1 to 1.0% by weight of Y based on the total weight of the spray coating material, wherein if Co is present, the content of Co is in a range of 20 to 40% by weight, and the balance is Ni and/or Cr, and if Cr is present, the content of Cr is in a range of 15 to 30% by weight, and the balance is Ni and/or Co. The present inventors have found that the disadvantages associated with the prior art can be overcome by provision of such powdered metal spray coating material.

Conveniently, the powdered metal spray coating material according to the present invention comprises 40 to 60% by weight of Ni, 20 to 40% by weight of Co, 15 to 25% by weight of Cr and 0.1 to 1.0% by weight of Y.

The spray coating material according to the present invention has a very good spray coating property to a base metal and an Ni plating layer and exhibits a very excellent durability as a layer for bonding or joining the base metal or plating layer with a ceramic layer, and an excellent deposition of a ceramic layer spray-coated thereonto due to an oxidated coating formed by Ni, Cr and Co under an effect of Y. For such properties, it is convenient that each of the constituents for the spray coating material is used in an amount within the above-defined range. If Y is used in an amount less than the above-defined range, the oxidated coating may be unsufficiently formed, whereas if the amount of Y is too large, an over-oxidated coating having poor durability and wear resistance may be formed. If the amounts of Ni, Cr and Co are either more and less than the above-defined ranges, an alloy characteristics may be lost, and the resulting spray coating material has properties degraded.

The present invention also provides a process for producing a powdered metal spray coating material of the type described above, comprising the steps of melting and homogenizing individual starting metals, particularly, 40 to 60% by weight of Ni, 20 to 40% by weight of Co, 15 to 25% by weight of Cr and 0.1 to 1.0% by weight of Y in vacuum, and forming the metals into a powder by means of a gas atomizer.

Further, the present invention provides a discontinuously casting copper or copper alloy mold comprising a Ni-plating layer formed on an inner surface of a mold substrate, a coating layer formed as an intermediate layer by spray-coating of a powdered metal spray coating material according to the present invention, and a porous $ZrO_2/Y_2O_3$ ceramic coating layer as a top coating layer, the composition of the ceramic layer comprising 98 to 85% by weight of $ZrO_2$ and 2 to 15% by weight of $Y_2O_3$.

Yet further, the present invention contemplates a discontinuously casting mold comprising a coating layer formed on an inner surface of a mold substrate of cast iron, steel or iron-based special alloy by spray coating of a powdered metal spray coating material according to claim 1, and a porous $ZrO_2/Y_2O_3$ ceramic coating layer as a top coating layer, the composition of the ceramic layer comprising 98 to 85% by weight of ZrO2 and 2 to 15% by weight of Y203.

DETAILED DESCRIPTION OF THE INVENTION

Base metal on which the powdered metal spray coating material of the present invention can be applied include cast iron, steel, iron-based special alloys, and copper or copper alloys. Places at which the spray coating material of the present invention can be used are not limited, but it is convenient that it will be sprayed onto places with which a molten metal of aluminum or aluminum alloy or a molten magnesium or magnesium alloy will come into contact, e.g., onto molten metal-contacted surfaces of a mold, a ladle and a pouring basin other than a crucible in a melting furnace.

The powdered spray coating material of the present invention produced in the above manner can be spray-coated by conventional methods such as a plasma spray coating and a high temperature spray coating.

A coating layer provided after spray coating using the metal spray coating material of the present invention has an excellent heat resistance such that it can withstand a temperature up to 1300° C.

The ceramic layer serves to remove a gas during casting and also to significantly improve the heat resistance and durability of the mold. Further, it has a very good deposition on the layer of the metal spray coating material of the present invention.

The mold provided with these layers exhibits a durability enough to withstand great many shots, e.g., 35,000 shots, of the casting process, as compared with the prior art mold, in producing a molded product of aluminum, aluminum alloy, magnesium or magnesium alloy, even if the base metal is a copper alloy.

Examples in which the spray coating material of the present invention is applied to a casting mold blank made of a copper alloy will be described below.

First, an Ni-plating layer is formed on an inner surface of a mold substrate made of each of copper alloys Nos. 1 to 8 given in the following Table (the balance of each alloy in Table is copper) to a thickness of 50 to 300 μm, particularly, 100 to 200 μm by a usual method, and a spray coating material having an alloy composition as described above according to the present invention is applied onto the Ni-plating layer to a thickness of 50 to 600 μm, particularly 200 to 300 μm by plasma spray coating at a temperature of about 10,000 to about 5,000° C. or by a high temperature spray coating at about 2,700° C., while cooling with water by means of an intra-mold water cooler if necessary. Then, a ceramic coating layer of a composition comprising 98 to 85%, particularly, 95 to 90% by weight of $ZrO_2$ and 2 to 15%, particularly, 5 to 10% by weight of $Y_2O_3$ is formed thereon to a thickness of 50 to 500 μm, particularly, 200 to 300 μm by spray coating under a similar condition. A large number of open pores are produced in the ceramic layer and hence, the latter is porous. The size of pores in the porous layer is not so large as to produce an unevenness on a surface of a molded product and is such that the pores can be observed by a microscope.

| Alloy No. | Incorporated metal (%) | | Coefficient of thermal conductivity |
|---|---|---|---|
| 1 | Sn | 0.3 | 6 |
| 2 | Zr | 0.15 | 7 |
| 3 | Zn | 0.15 | 5 |
| 4 | Si | 0.5 | 4 |
| 5 | Be | 0.25 | 6 |

-continued

| Alloy No. | Incorporated metal (%) | | Coefficient of thermal conductivity |
|---|---|---|---|
| 6 | Cr | 0.85 | 7 |
| 7 | Ti | 0.2 | 5 |
| 8 | Zr 0.15 and Cr 0.85 | | 6 |

The mold made utilizing the spray coating material of the present invention has a layer formed of the spray coating material, which is very good as a bonding layer, in spite of a considerable difference in coefficient of thermal expansion between such layer and the base metal. Further, this spray coating material layer has a high durability and a high wear resistance. The mold made in the above manner is capable of withstanding 35,000 shots of the casting process without a need for application of a soft facing material on the inner surface of the mold.

The present invention will now be described in more detail by way of Examples and Comparative Examples.

EXAMPLE OF PRODUCTION 1) 445.5 g of Ni, 350 g of Co, 200 g of Cr and 5.5 g of Y are molten in a melting crucible which has been brought into a vacuum condition by a vacuum pump, and the resulting melt is then formed into a fine powder having an average particle size of 30 μm by a gas atomizer.

2) A fine powder having an average particle size of 50 μm is formed in the same manner as in Example 1, except for the use of 490.5 g of Ni, 330 g of Co, 174 g of Cr and 5.5 g of Y.

3) 795.5 g of Ni, 200 g of Cr and 4.5 g of Y are molten in a melting crucible which has been brought into a vacuum condition by a vacuum pump, and the resulting melt is then formed into a fine powder having an average particle size of 30 μm by a gas atomizer.

4) A fine powder having an average particle size of 50 μm is formed in the same manner as in Example 3, except for the use of 664.5 g of Ni, 330 g of Co and 5.5 g of Y.

5) 795.5 g of Co, 200 g of Cr and 4.5 g of Y are molten in a melting crucible which has been brought into a vacuum condition by a vacuum pump, and the resulting melt is then formed into a fine powder having an average particle size of 30 μm by a gas atomizer.

EXAMPLE OF USE

1) An Ni plating layer having a thickness of 200 μm is formed by an electro-plating process onto an inner surface of a mold blank made of a copper alloy No. 2 containing 0.15% by weight of zirconium and having a coefficient of thermal conductivity of 7. Then, the spray coating material produced in Production Example 1 is applied thereon by a plasma spray coating process at 8,000° C. to form a coating film having a thickness of 150 μm.

A ceramic mixture of 92% by weight of $ZrO_2$ 8% by weight of $Y_2O_3$ is applied onto thus-formed metal coating layer to a thickness of 250 μm by a similar spray coating process. In this case, the spray coating temperature is of 8,000° C. A large number of very small pores are present in the ceramic layer and hence, the latter is porous.

The copper alloy mold made in this manner was used for the production of an aluminum alloy casing for an engine of an automobile in a casting process with cooling to 350° to 400° C. and as a result, even if 35,000 shots were conducted, any change on the surface of the mold was not still observed, and the surface of the molded product was satisfactory.

2) A permanent mold was produced in the same manner as in Use Example 1, except for the use of a mold blank made of a copper alloy No. 7 containing 0.2% by weight of Ti and having a coefficient of thermal conductivity of 5 and the use of the spray coating material produced in Production Example 2 and of a ceramic mixture of 92% by weight of $ZrO_2$ and 8% by weight of $Y_2O_3$. This mold was used to conduct a casting experiment for producing an aluminum alloy casing for an automobile engine in a casting process as in Use Example 1 and as a result, even if 35,000 shots were carried out, any change on the surface of the mold was still not observed, and the surface of a molded product was satisfactory.

3) A copper alloy mold was produced in the same manner as in Use Example 1, except for the use of the spray coating material produced in Production Example 3. A casting experiment for producing an aluminum alloy casing for an automobile engine in a casting process was carried out in this mold in the same manner as in Use Example 1 and as a result, even if 35,000 shots were conducted, any change on the surface of the mold was still not observed, and the surface of a molded product was satisfactory.

4) A permanent mold was produced in the same manner as in Use Example 2, except for the use of the spray coating material produced in Production Example 4. A casting experiment for producing an aluminum alloy casing for an automobile engine in a casting process was carried out in this mold in the same manner as in Use Example 1 and as a result, even if 35,000 shots were conducted, any change on the surface of the mold was still not observed, and the surface of a molded product was satisfactory.

5) A permanent mold was produced in the same manner as in Use Example 2, except for the use of the spray coating material produced in Production Example 5. A casting experiment for producing an aluminum alloy casing for an automobile engine in a casting process was carried out in this mold in the same manner as in Use Example 1 and as a result, even if 35,000 shots were conducted, any change on the surface of the mold was still not observed, and the surface of a molded product was satisfactory.

6) A permanent mold was produced in the same manner as in Use Example 2, except that the spray coating material produced in Production Example 3 was spray-coated onto an inner surface of a steel mold blank without spray coating of Ni. A casting experiment for producing an aluminum alloy casing for an automobile engine in a casting process was carried out in this mold in the same manner as in Use Example 1, except that the cooling was not conducted, and as a result, even if 35,000 shots were conducted, any change on the surface of the mold was still not observed, and the surface of a molded product was satisfactory.

It can be seen from Use Examples 1 to 6 that the spray coating material according to the present invention is very satisfactory for a layer for bonding or joining a base metal and a ceramic layer.

COMPARATIVE EXAMPLES

1) Using a spray coating material comprising 55% by weight of Co, 30% by weight of Mo and the balance of Cr, it was applied onto a base metal by spray coating in the same manner as in Use Example 1. Then, it was attempted to apply the ceramic material described in Use Example 1 thereonto by spray coating and as a result, the ceramic material was only unsufficiently deposited.

2) The same procedure as in Use Example 1 was repeated, except for the use, as a spray coating material, of a powder alloy comprising 25% by weight of Co, 3% by weight of Al, 17% by weight of Cr, 0.45% by weight of Y and 54.55% by weight of Ni. The test was also conducted in the same manner as in Use Example 1 and as a result, the peeling-off of a surface of an aluminum alloy molded product was observed after cooling.

It is estimated that this has occured as a result of adhesion of aluminum in the molten metal to aluminum in the bonding layer through micro-pores in the ceramic layer.

What is claimed is:

1. A process for producing a powdered metal spray coating material consisting of two or more of Ni, Cr and Co, and 0.1 to 1.0% by weight of Y based on the total weight of the spray coating material, wherein if Co is present, the content of Co is in a range of 20 to 40% by weight, and the balance selected from the group consisting of Ni and Cr, and if Cr is present, the content of Cr is in a range of 15 to 30% by weight, and the balance is selected from the group consisting of Ni and Co; said process comprising the steps of melting and homogenizing starting metals consisting essentially of the above composition in a vacuum and forming them into a metal powder by a gas atomizer.

2. A process for producing a powdered metal spray coating material consisting of Ni, Cr, Co, and 0.1 to 1.0% by weight of Y based on the total weight of the spray coating material, wherein the content of Co is in a range of 20 to 40% by weight, the content of Cr is in a range of 15 to 25% by weight, the content of Ni is 40% to 60% by weight, comprising the steps of melting and homogenizing starting metals consisting essentially of 40 to 60% by weight of Ni, 20 to 40% by weight of Co, 15 to 25% by weight of Cr and 0.1 to 1.0% by weight of Y in a vacuum, and then forming a metal powder from said starting metals by a gas atomizer.

* * * * *